US006131768A

United States Patent [19]

Taivalkoski et al.

[11] Patent Number: 6,131,768

[45] Date of Patent: Oct. 17, 2000

[54] MULTI-FUEL DISPENSER EMPLOYING A SINGLE METER WITH BYPASS LOOP AND MULTIPLE HOSES

[75] Inventors: Tom Taivalkoski; William Goggin, both of Fort Wayne, Ind.

[73] Assignee: Tokheim Corporation, Fort Wayne, Ind.

[21] Appl. No.: 09/318,423

[22] Filed: May 25, 1999

[51] Int. Cl.[7] ..... B67D 5/30

[52] U.S. Cl. ..... 222/14; 222/71; 222/144.5; 222/318

[58] Field of Search ..... 222/1, 132, 144.5, 222/14, 71, 135, 318; 137/3

[56] References Cited

U.S. PATENT DOCUMENTS

| | | |
|---|---|---|
| 2,984,388 | 5/1961 | Scarr et al. . |
| 3,705,596 | 12/1972 | Young . |
| 3,747,624 | 7/1973 | Young . |
| 3,847,302 | 11/1974 | Krone et al. . |
| 3,934,756 | 1/1976 | Young et al. . |
| 3,946,900 | 3/1976 | DuBrueler, Jr. . |
| 4,083,473 | 4/1978 | Goodwin et al. . |
| 4,360,127 | 11/1982 | Maruyama et al. . |
| 4,397,405 | 8/1983 | Batson . |
| 4,576,312 | 3/1986 | Swick, Jr. . |
| 4,876,653 | 10/1989 | McSpadden et al. . |
| 4,930,665 | 6/1990 | Devine . |
| 4,978,029 | 12/1990 | Furrow et al. . |
| 5,018,645 | 5/1991 | Zinsmeyer . |
| 5,139,045 | 8/1992 | Ensign . |
| 5,163,586 | 11/1992 | Zinsmeyer . |
| 5,203,366 | 4/1993 | Czeck et al. . |
| 5,275,189 | 1/1994 | Ensign . |
| 5,363,988 | 11/1994 | Saxton et al. . |
| 5,433,342 | 7/1995 | Luro . |
| 5,490,612 | 2/1996 | Coquerel et al. . |
| 5,630,528 | 5/1997 | Nanaji . |
| 5,651,478 | 7/1997 | Tatsuno . |
| 5,979,705 | 11/1999 | Kaehler et al. ..... 222/71 |

*Primary Examiner*—Philippe Derakshani
*Attorney, Agent, or Firm*—Randall J. Knuth

[57] ABSTRACT

A method and apparatus for blending and dispensing fluids with multi-directional selector valves, a single meter, and a mechanism for purging the dispenser. The single multi-directional selector valve and single meter is used for reducing the number of leakage points in a dispenser, to simplify the dispenser, and to reduce the production cost of the dispenser. Purging is used for decontaminating the fluid dispenser of fluids previously used by the dispenser and to ensure proper fluid grade.

38 Claims, 9 Drawing Sheets

MULTI-FUEL DISPENSER EMPLOYING A SINGLE METER WITH BYPASS LOOP AND MULTIPLE HOSES

BACKGROUND OF THE INVENTION

1. Field of the Invention

The present invention relates to a method and apparatus for dispensing fluids, particularly fuel, with multiple product choices, through a single product selector valve, a single meter, a bypass loop and single or multiple product outlets. It is the purpose of the multi-product dispenser to reduce the number of parts, leakage points, and production costs necessary for operating a dispensing system as well as to obtain a higher grade of fluid for the user.

2. Description of the Related Art

Dispensing systems for delivering multiple grades of fluid products are known.

Some systems include multiple-grade fluid sources with single or multiple fluid outlets for dispensing various grades of fluid. Each fluid source includes a pump to dispense the fluid from its source to its respective meter for measuring the volume of fluid. The fluid then remains in its original concentration or it is blended with other fluids to form a separate concentration before reaching the fluid outlet. The problem with these systems is that multiple meters are used to meter the fuel from its respective source. This can increase the costs of manufacturing, increase the volume of the dispensing unit, complicate service, and create more leakage points.

Another problem with these systems occur when a single fluid outlet or fluid line dispenses multiple grades of fluid. Lower grades of fluid can remain in the system while the user attempts to obtain a higher grade of fluid. This contamination can often present a lower grade of fluid than required. One solution is to leave the lower grade of fluid in the system and combine it with higher grade, hoping that the combination would have sufficient grade to satisfy state and federal regulations. However, this can be disadvantageous for users who only dispense a small volume of fluid since the volume within the system creates a large variation on the grade of the fluid and places a design limitation on the system due to the small volume. Another solution is to place residual high grade fluid in the system in order to compensate for the lower grade fluid previously dispensed. However, this can complicate the system and fail to give the user the expected grade of fluid when the highest grade has been selected or a small volume is desired.

Other systems that use only a single meter require multiple control valves in order to meter multiple fluid sources before reaching the fluid outlet. Each fluid source includes a pump to dispense the fluid from its source to its respective inlet selector valve. Only a single inlet selector valve is opened so that the fluid can be measured by the single meter. The fluid then flows from the meter to either a single fluid outlet or through an outlet control valve which dispenses the fluid to its respective outlet when multiple outlets are used. The problem with this system is that the lower grade of fluid may be trapped between each inlet selector valve and the single outlet or each outlet control valve if multiple outlets are used, which can produce a lower grade of fluid than desired. One solution is to decrease the internal volume between the inlet selector valve and the single outlet or each outlet control valve when multiple outlets are used. However, this can be disadvantageous for users who only dispense a small volume of fluid since the volume within the system creates a large variation on the grade of the fluid and it places a design limitation on the system due to the small volume. Another problem with this system is that the multiple control valves can complicate the design of the system, complicate servicing, and create more potential leakage points which are exposed during assembly and servicing of the system which can be limited by state and federal regulations.

SUMMARY OF THE INVENTION

According to the present invention, the multi-product fuel dispenser employs a single meter, bypass loop, and multiple hoses. The multi-product dispenser reduces the number of parts, production costs, and leakage points necessary to operate a dispensing system as well as obtain a higher grade of fluid for the user.

The invention, in one form thereof, includes an inlet selector valve for each of the fluid sources. The inlet selector valve is operated to control the flow of fluid from a fluid source in order to obtain the desired fluid ratio. The inlet selector valve is then in fluid communication with a single meter which measures the amount of fluid discharged. The meter is in fluid communication with a fluid discharge outlet or an outlet control valve which is provided to control the flow of fluid for a fluid discharge outlet. A means to purge the fluid is also in fluid communication between the inlet selector valve and the fluid discharge outlets and is operated to purge the flow lines of low grade fuel.

In another embodiment, a multi-directional bypass control valve is used to operate the purging of the flow lines to a source. In a further embodiment, the fluid in the flow lines is purged to a fluid source. In the preferred embodiment, the fluid in the flow lines is purged to the conforming fluid source.

In the preferred embodiment, each of the inlet selector valves is replaced with a single inlet multi-directional selector valve that is operated to control the flow of fluid from each of the fluid sources to the meter. In a further embodiment, the multi-directional bypass control valve is in fluid communication with the inlet multi-directional selector valve in order to control the purge of fluid.

In yet a further embodiment, a fluid discharge nozzle is used for the fluid discharge outlet. In another embodiment, a pump is in fluid communication with each fluid source upstream of the inlet multi-directional selector valve or inlet selector valves. The pump is controlled to produce the desired flow ratio from each fluid source.

An advantage of the present invention is the ability to operate a multi-product dispenser with a single meter. This decreases the total volume of the dispenser housing needed as well as reducing the total cost of production. Also, with a single meter, service is simplified and leakage points are reduced since the single meter incorporates all fluid sources and limits the number of repairable components.

Another advantage of the present invention is the purging of lower grade liquids in order to decontaminate the dispenser. This allows the fluid to flow initially through the dispenser while the dispenser remains substantially empty. The user can obtain an accurate fluid octane when the highest grade of fluid has been selected and when a low volume is needed from the dispenser. Also, the fuel dispenser design is simplified since a residual of high grade liquid will not be needed to upgrade any present lower grade liquid.

A further advantage of the invention is to expand the design limitations of the dispenser since the lower grade liquid is purged from the system. This allows for the volume within the inlet selector valve and the outlet control valve or fluid discharge outlet to increase while maintaining an accurate fluid octane through the fluid discharge outlet when state and/or federal regulations monitor the grade of the fluid dispensed.

Another advantage of the present invention is the reduction of leakage points to the meter. A single meter line combines the selector valves or multi-directional selector valve before the fluid flows to the meter. The reduction of leakage points to the meter reduces service time and production of the dispenser since fewer components are required to connect the multiple sources and multiple outlets to the meter.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates preferred embodiments of the invention, in one form, and such exemplification is not to be construed as limiting the scope of the invention in any manner.

DETAILED DESCRIPTION OF THE INVENTION

Figure 1:
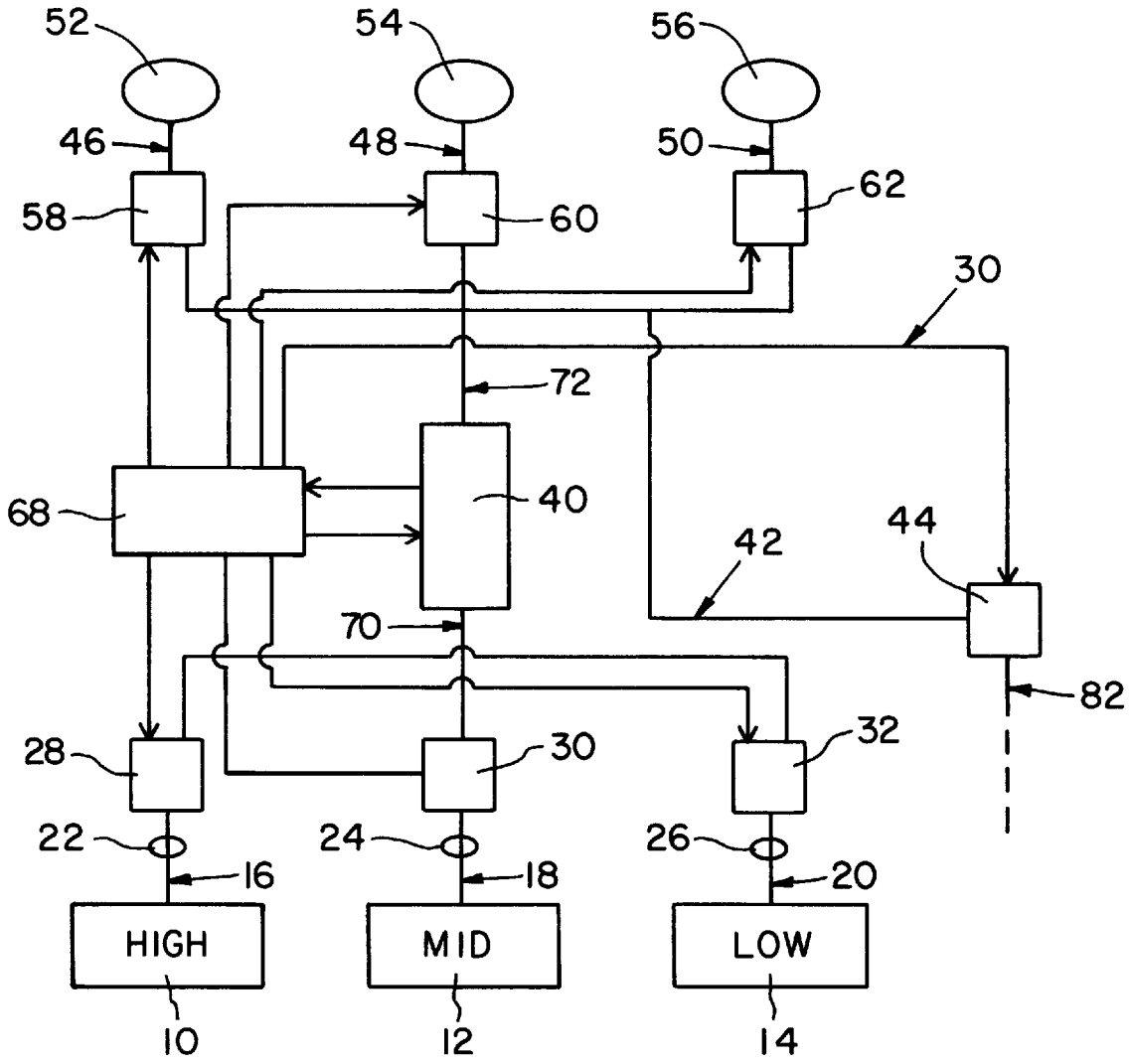
FIG. 1 is a schematic representation of the fuel dispenser with a selector valve, a fluid outlet and a bypass control valve for each fluid source.

Referring now to the drawings and particularly to FIG. 1, there is shown a schematic representation of one embodiment of the fuel dispenser with inlet selector valves 28, 30, 32 for each fluid source 10, 12, 14 and fluid discharge outlets 52, 54, 56 and a multi-directional bypass control valve 44. In accordance with the present invention, the multi-product dispenser includes three fluid sources 10, 12, 14 with connection lines 16, 18, 20 to pumps 22, 24, 26 which is responsive to controlling device 68 for producing the desired fluid ratio from the three fluid sources 10, 12, 14. In this embodiment, the fluid then flows through connection lines 16, 18, 20 to inlet selector valves 28, 30, 32 which is responsive to controlling device 68 in order to control the flow of fluid from fluid sources 10, 12, 14. Inlet selector valve 28 controls the fluid from high grade fluid source 10 which flows through connection line 16 that is produced by pump 22. Inlet selector valve 30 controls the fluid from a medium grade fluid source 12 which flows through connection line 18 that is produced by pump 24. Inlet selector valve 32 controls the fluid from low grade fluid source 14 which flows through connection line 20 that is produced by pump 26. The fluid that passes through inlet selector valves 28, 30, 32 is then combined at meter inlet line 70. Preferably, meter inlet line 70 is one continuous component with three inlets connected to inlet selector valves 28, 30, 32 respectively, and an outlet that flows into meter 40 which measures the amount of fluid that is to be discharged. Meter 40 is responsive to controlling device 68 and returns a signal to controlling device 68 of the fluid measured. In this embodiment, the fluid then flows from meter 40 through meter outlet line 72 which then splits to outlet control valves 58, 60, 62 which are controlled by controlling device 68. Preferably, meter outlet line 72 is one continuous component with one inlet connected to meter 40 and three outlets connected to outlet control valves 58, 60, 62. Outlet control valve 58 controls the flow of fluid from meter outlet line 72 through hose 46 to fluid discharge outlet/nozzle 52. Outlet control valve 60 controls the flow of fluid from meter outlet line 72 through hose 48 to fluid discharge outlet/nozzle 54. Outlet control valve 62 controls the flow of fluid from meter outlet line 72 through hose 50 to fluid discharge outlet/nozzle 56. A bypass inlet line 42 is connected to meter outlet line 72 which allows the flow of fluid to a multi-directional bypass control valve 44 which is responsive to controlling device 68 for controlling the flow of fluid in bypass inlet line 42 to bypass sump line 82 which leads to either a source, low grade fluid source 14, or its corresponding fluid source 10, 12, 14 which is used as a bypass sump as described below.

In operating the device, controlling device 68 is activated to select a grade of fluid, which for this example will be high grade fluid. The controller then sends a signal to pump 22 to produce flow rate from fluid source 10. The controller also sends a signal to inlet selector valve 28 which opens the respective valve and closes selector valves 30 and 32 and opens the valves in the multi-directional bypass control valve 44. The fluid then flows from inlet selector valve 28, through meter inlet line 70 where the fluid passes, through meter 40 which measures the flow of fluid to bypass inlet line 42, through open multi-directional bypass control valve 44, once a predetermined amount of fluid is discharged through multi-directional bypass control valve 44, and controller 68 closes multi-directional bypass control valve 44. Fluid then passes to the desired outlet, through the appropriate outlet control valve for dispensing. Once the desired amount of fluid is dispensed, controlling device 68 causes inlet selector valve 28 and outlet control valve 58 to close.

Figure 3:
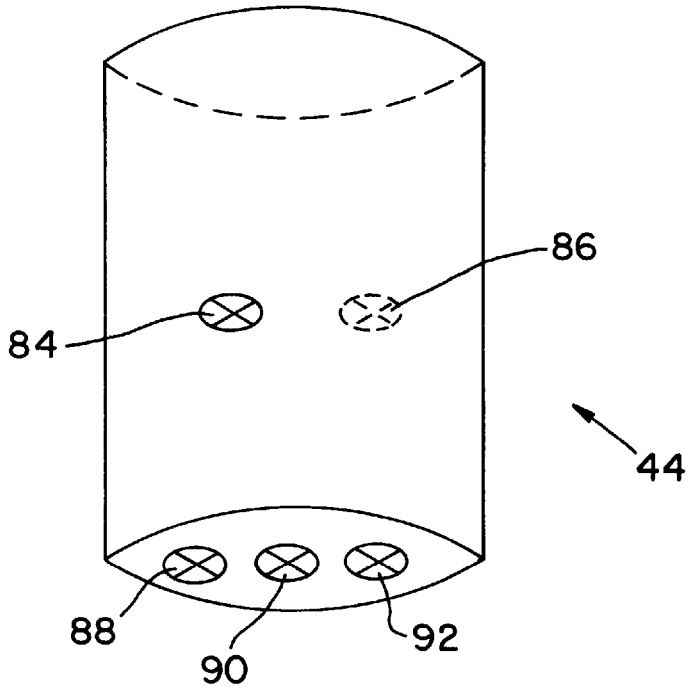
FIG. 3 is the embodiment for the multi-directional bypass control valve.
Figure 4:
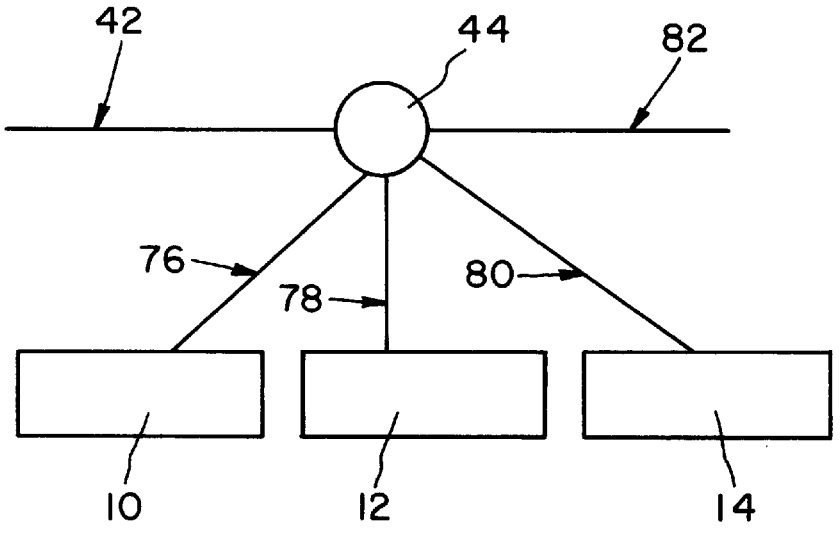
FIG. 4 is a schematic representation of the multi-directional bypass control valve.

As seen in FIGS. 3 and 4, multi-directional bypass control valve 44 is cylindrical in shape and is connected to bypass inlet line 42 with a check valve 84 that controls the flow of fluid from bypass inlet line 42 to multi-directional bypass control valve 44. The desired source used as a bypass sump for disposing of the flow of fluid influences the design of multi-directional bypass control valve 44. Bypass sump line 82 as shown in FIG. 1 is broken up as bypass sump lines 76, 78, 80 and 82 in FIG. 4. One solution for disposing of the liquid is for multi-directional bypass control valve 44 to have a check valve 86 that is attached to an independent bypass sump line 82 that leads to an independent source that is used as a bypass sump. This independent source includes such items as a tank, or other drainage and/or storage systems. Another solution for disposing of the liquid is for multi-directional bypass control valve 44 to have a check valve 92 that is attached to low grade bypass sump line 80 that sends the fluid to low grade fluid source 14 which is used as a bypass sump. This maintains the current grade of the medium and high grade fluid while the low grade fuel remains the same or improves. Yet another solution for disposing of the liquid is for multi-directional bypass control valve 44 to have a check valve 88 that is attached to a high grade bypass sump line 76 that sends the fluid to high grade fluid source 10 which is used as a bypass sump, a check valve 90 that is attached to a medium grade bypass sump line 78 that sends the fluid to medium grade fluid source 12 which is used as a bypass sump, and a check valve 92 that is attached to a low grade bypass sump line 80 that sends the fluid to low grade fluid source 14 which is used as a bypass sump. A check valve would then be opened to a fuel source according to the grade of fuel that remained in the system. The fuel source used as a bypass sump would be as shown:

| Grade of Fluid Dispensed | Fuel Source Used as Bypass Sump |
|---|---|
| High | High |
| High-Medium | Medium |
| Medium | Medium |
| Medium-Low | Low |
| Low | Low |

This maintains the grade of fuel for high grade fluid source 10 while medium grade fluid source 12 and low grade fluid source 14 remains the same or improves to a higher grade. In accordance with the present example, check valve 90 for medium grade bypass sump line 78 would open causing the liquid to go to medium grade fluid source 12 which is used as the bypass sump since the grade of fluid was high-medium.

As a result of the above-described operation, the fuel system is devoid of lower grade fluid. This allows the user to obtain the desired fuel grade or higher since they are presented with a purged system. The design limitations for the control valves has been expanded since controller 68 can calculate the required fluid necessary to fill the purged fluid lines causing an acceptable fluid ratio when the first fluid is dispensed. Also, the number of leakage points has been reduced since only one meter inlet line 70 and one meter outlet line 72 is used in connection with meter 40.

Figure 2:
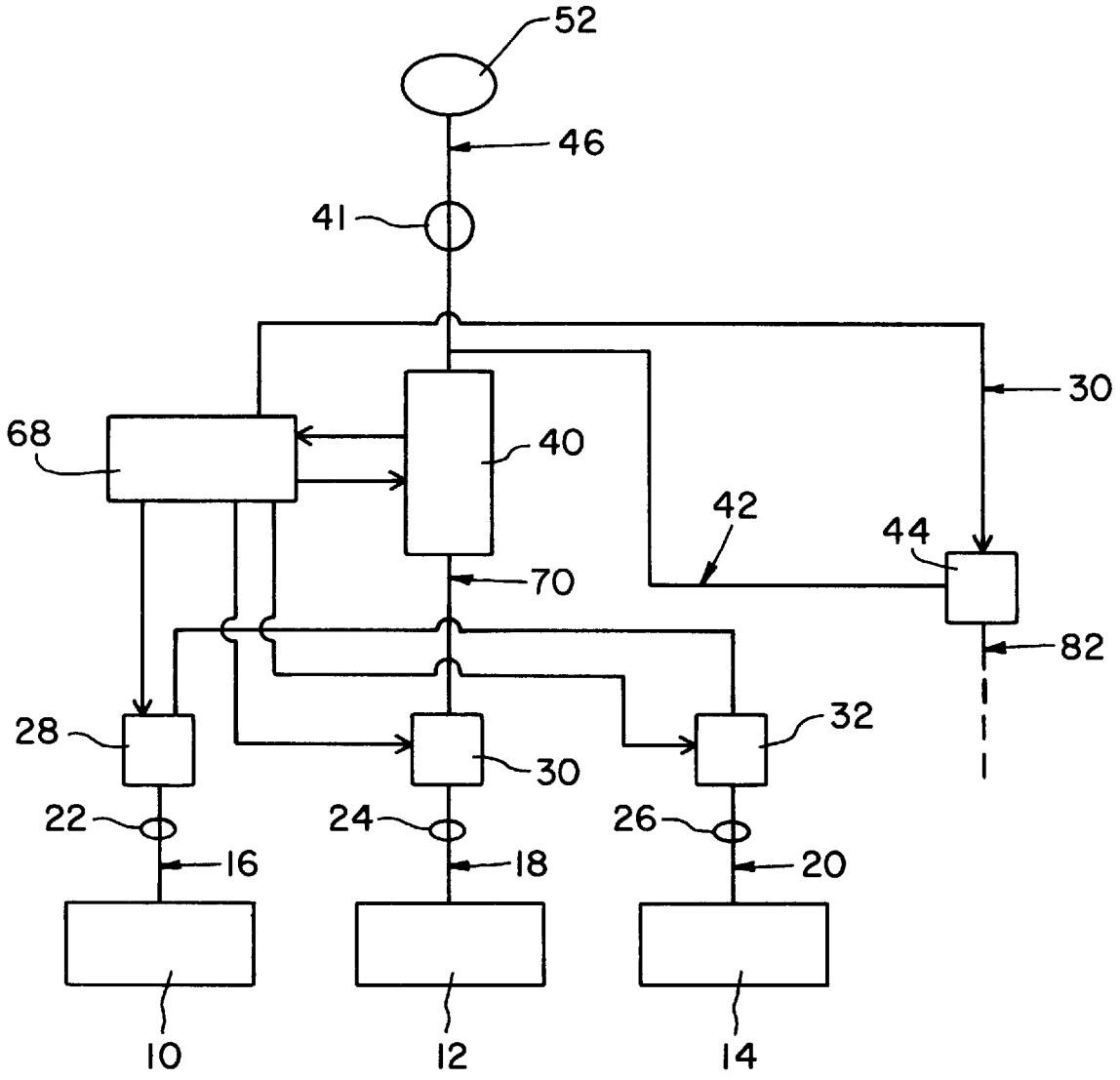
FIG. 2 is a schematic representation of the fuel dispenser with a control valve for each fluid source, one fluid outlet, and a bypass control valve.

Referring now to the drawings and particularly to FIG. 2, there is shown a schematic representation of another embodiment of the fuel dispenser with inlet selector valves 28, 30, 32 for each fluid source 10, 12, 14, one fluid discharge outlet/nozzle 52, and multi-directional bypass control valve 44. As can be seen in FIG. 2, the embodiment of FIG. 2 is similar to FIG. 1 except that only one fluid discharge outlet/nozzle 52 exists with a single discharge hose 46 connected to meter 40 to discharge fluid from fluid sources 10, 12, 14. Accordingly, outlet control valves are not required nor is meter outlet line 72. A dual flow valve 41 maybe operatively associated with hose 46 to permit both fast flow and slow flow operation. In all other respects, however, the embodiment of FIG. 2 is similar to and shares the same advantages of FIG. 1.

Figure 5:
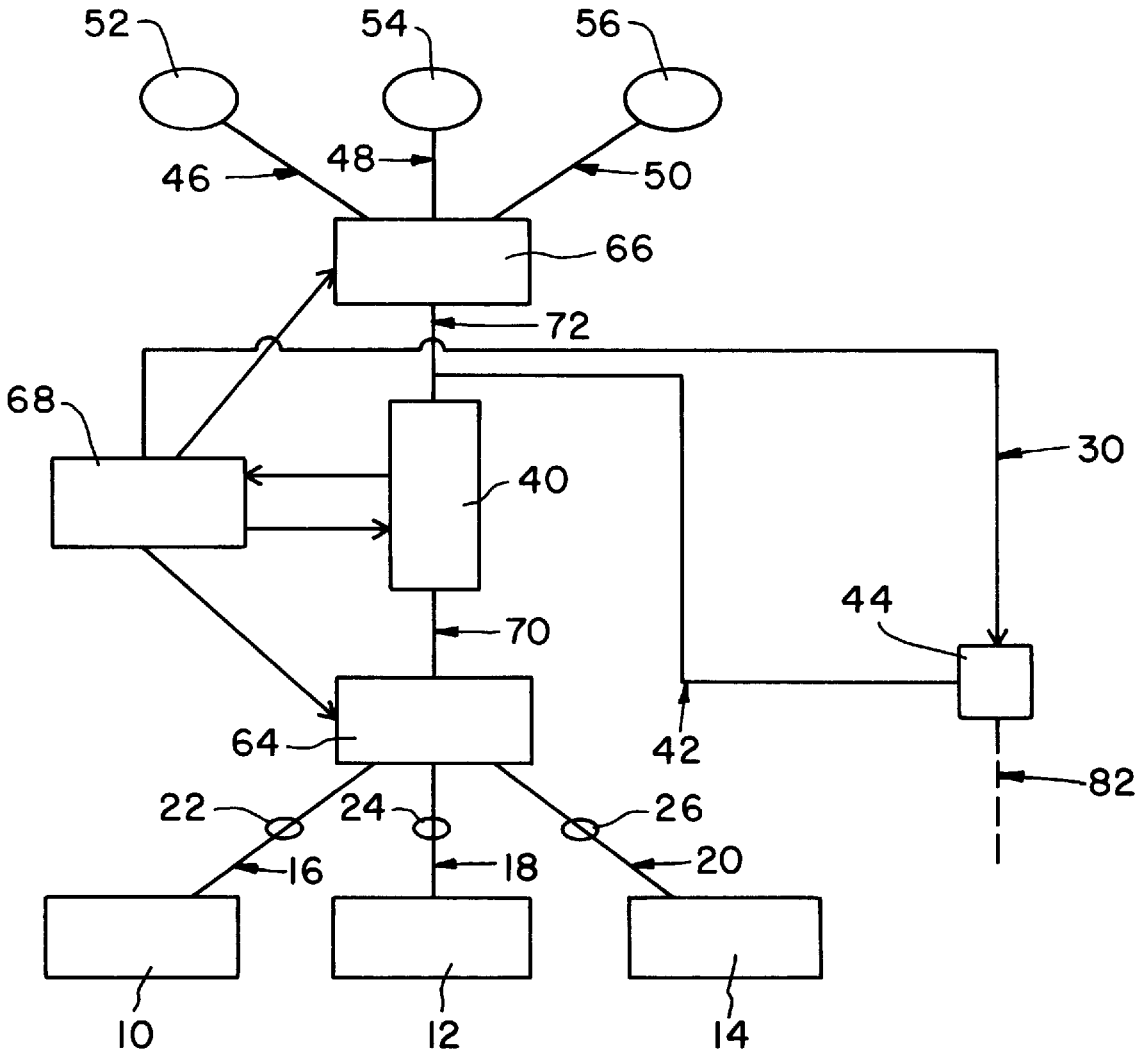
FIG. 5 is a schematic representation of the fuel dispenser with a single inlet multi-directional selector valve, a single outlet multi-directional selector valve, and a bypass control valve.

Referring now to the drawings and particularly to FIG. 5, there is shown a schematic representation of another embodiment of the fuel dispenser with a single inlet multi-directional selector valve 64, a single outlet multi-directional selector valve 66, and a bypass control valve 44. As in FIG. 1, fluid sources 10, 12, 14 flow through connection lines 16, 18, 20 to pumps 22, 24, 26 which produce the desired flow ratio. However, in this embodiment, connection lines 16, 18, 20 each flow into a single inlet multi-directional selector valve 64. Inlet multi-directional selector valve 64 is used to control the flow of fluid from each of fluid sources 10, 12, 14 and is responsive to controlling device 68 for producing the desired fluid ratio. The structure of inlet multi-directional selector valve 64 is discussed below. The fluid in inlet multi-directional selector valve 64 then flows into meter inlet line 70 which is attached to meter 40. Meter 40 receives from controlling device 68 the amount of fluid to be discharged and meter 40 returns a signal with the measured amount of fluid discharged through meter outlet line 72. In this embodiment, meter outlet line 72 then flows into single outlet multi-directional selector valve 66. Single outlet multi-directional selector valve 66 is responsive to controlling device 68 so that it can control the flow of fluid to each of fluid discharge hoses 46, 48, 50. The structure of single outlet multi-directional selector valve 66 is discussed below. As in FIG. 1, fluid discharge hoses 46, 48, 50 then flow into fluid discharge outlets/nozzles 52, 54, 56. A bypass inlet line 42 is preferably connected to inlet multi-directional selector valve 64 for purging the fluid. The structure and operation of bypass inlet line 42 and multi-directional bypass control valve 44 is the same as seen in FIG. 1 for purging the flow of fluid from inlet multi-directional selector valve 64 to single outlet multi-directional selector valve 66.

Figure 7:
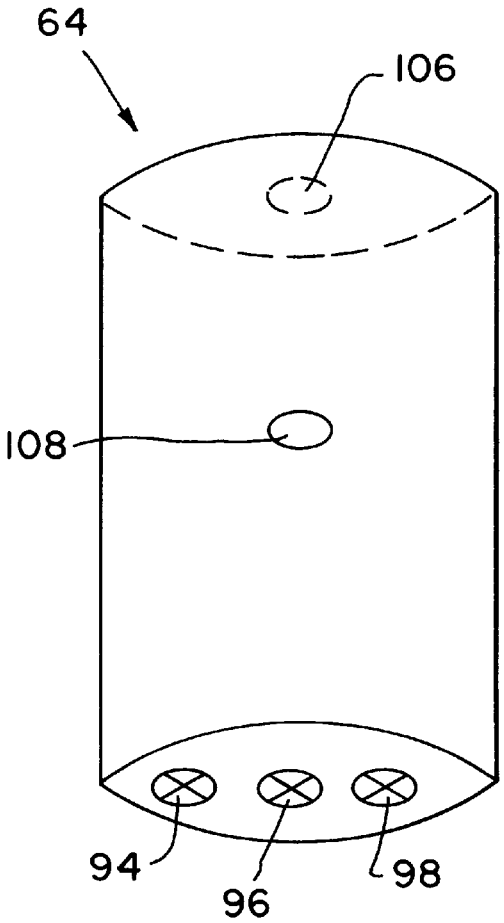
FIG. 7 is an embodiment of the inlet multi-directional selector valve.
Figure 8:
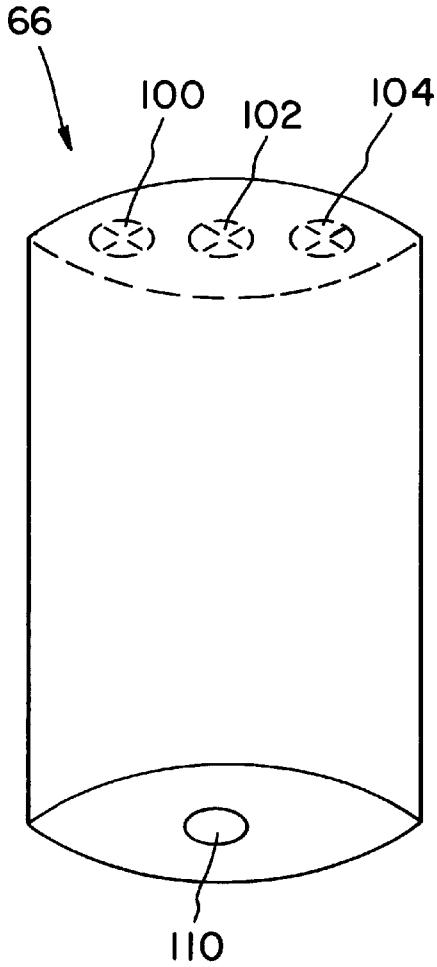
FIG. 8 is an embodiment of the outlet multi-directional selector valve.

In FIG. 7, single inlet multi-directional selector valve 64 is of cylindrical shape with a valve 94 for high grade fuel source 10, a valve 96 for medium grade fuel source 12, a valve 98 for low grade fuel source 14, an opening 106 for meter inlet line 70, and an opening 108 for bypass inlet line 42. In FIG. 8, single outlet multi-directional selector valve 66 is a cylindrical shape with an opening 110 for meter outlet line 72, a valve 100 for fluid discharge outlet/nozzle 52, a valve 102 for fluid discharge outlet/nozzle 54, and a valve 104 for fluid discharge outlet/nozzle 56.

In operating the device, controller 68 is activated to select a grade of fluid which, for this example, will be an even mix of high and medium grade fluid. The controller then sends a signal to pumps 22 and 24 to produce equal flow rates from fluid sources 10 and 12. The controller also sends a signal to inlet multi-directional selector valve 64 which opens valves 94 and 96 and closes valve 98 and opens the valves in multi-directional bypass control valve 44. The fluid then blends in inlet multi-directional selector valve 64 and flows through opening 106 to meter inlet line 70. The fluid then passes through meter inlet line 70 to meter 40 which measures the flow of fluid to bypass inlet line 42 and through open bypass control 44 as described above. Once a predetermined amount of fluid is discharged through bypass control valve 44, controller 68 closes bypass control valve 44. The fluid then flows from meter 40 through meter outlet line 72 which causes the flow of fluid to pass through opening 110 of single outlet multi-directional selector valve 66. The controller then sends a signal to single outlet multi-directional selector valve 66 which opens valve 100 and closes valves 102 and 104 so that the fluid will pass through fluid discharge hose 46 to fluid discharge outlet/nozzle 52. Controller 68 is then deactivated causing valves 94, 96, and 100 to close. As a result of the described operation, the same advantages are gained as those seen in FIG. 1.

Figure 6:
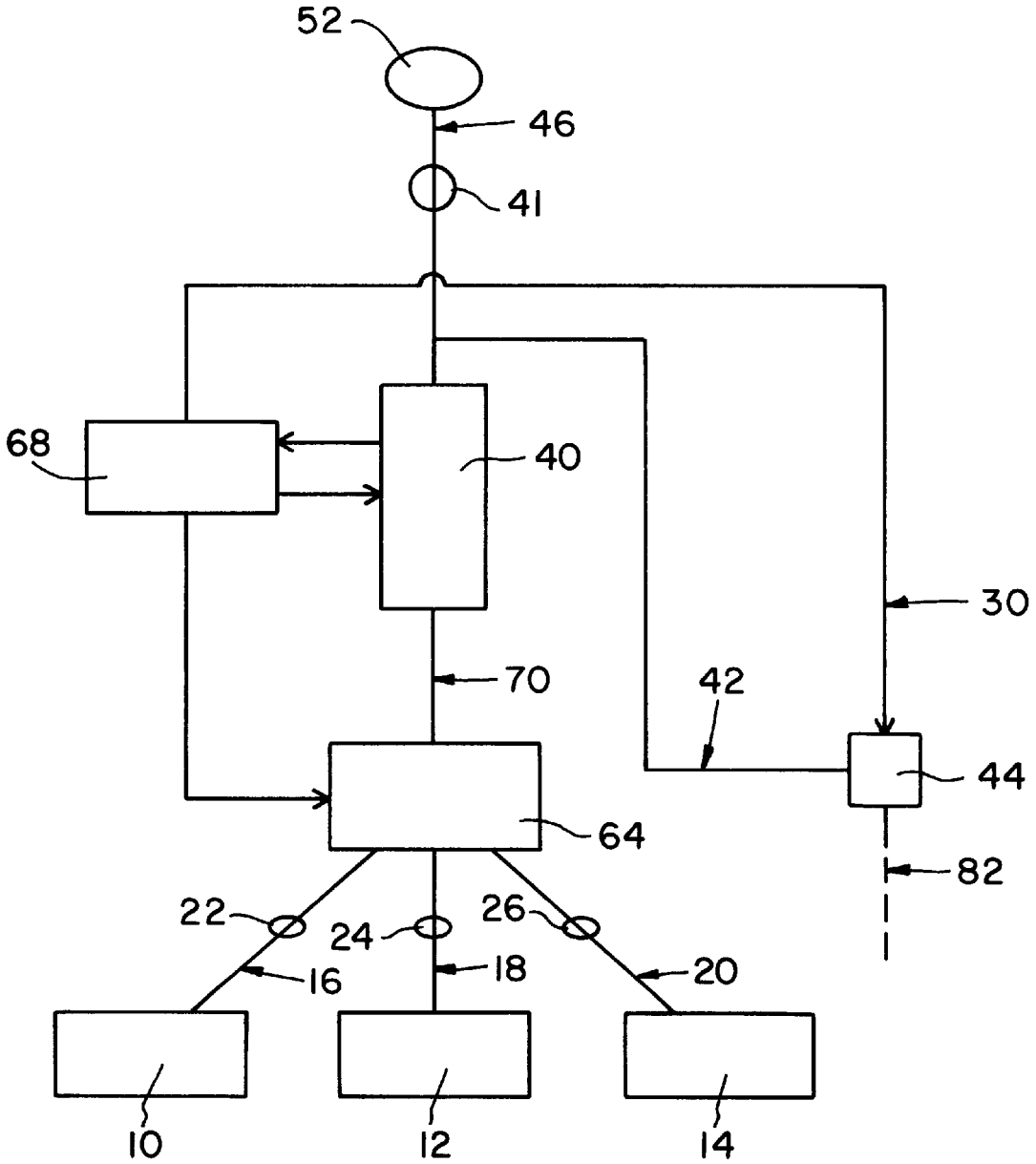
FIG. 6 is a schematic representation of the fuel dispenser with a single inlet multi-directional selector valve, one fluid outlet, and a bypass control valve.

Referring now to the drawings and particularly to FIG. 6, there is shown a schematic representation of another embodiment of the fuel dispenser with a single inlet multi-directional selector valve 64 for each fluid source 10, 12, 14, one fluid outlet 52, and a bypass control valve 44. As can be seen in FIG. 6, the embodiment of FIG. 6 is similar to FIG. 5 except that only one fluid discharge nozzle/outlet 52 exists with a single discharge hose 46 connected to meter 40 to discharge fluid from fluid sources 10, 12, 14. Accordingly, single outlet multi-directional selector valve 66 is not required nor is meter outlet line 72 required. A dual flow valve 41 maybe operatively associated with hose 46 to permit both fast flow and slow flow operation. In all other respects, however, the embodiment of FIG. 6 is identical to and shares the same advantages of FIG. 5.

Figure 10:
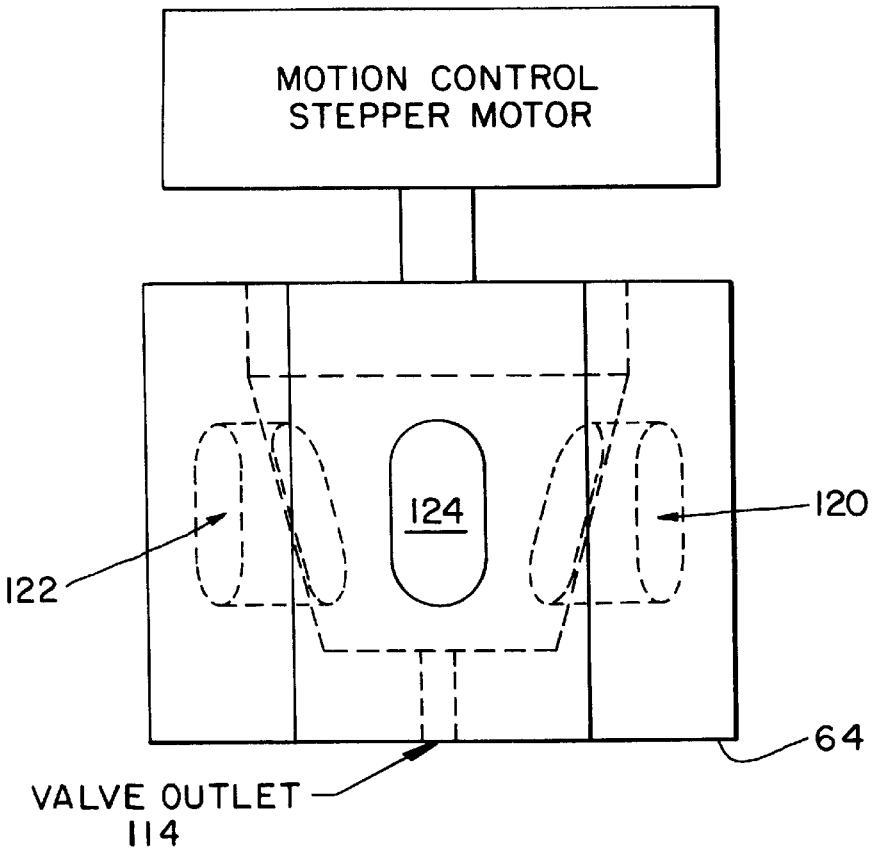
FIG. 10 is a side elevational view of a selector valve used in accordance with one embodiment of the current invention.
Figure 9:
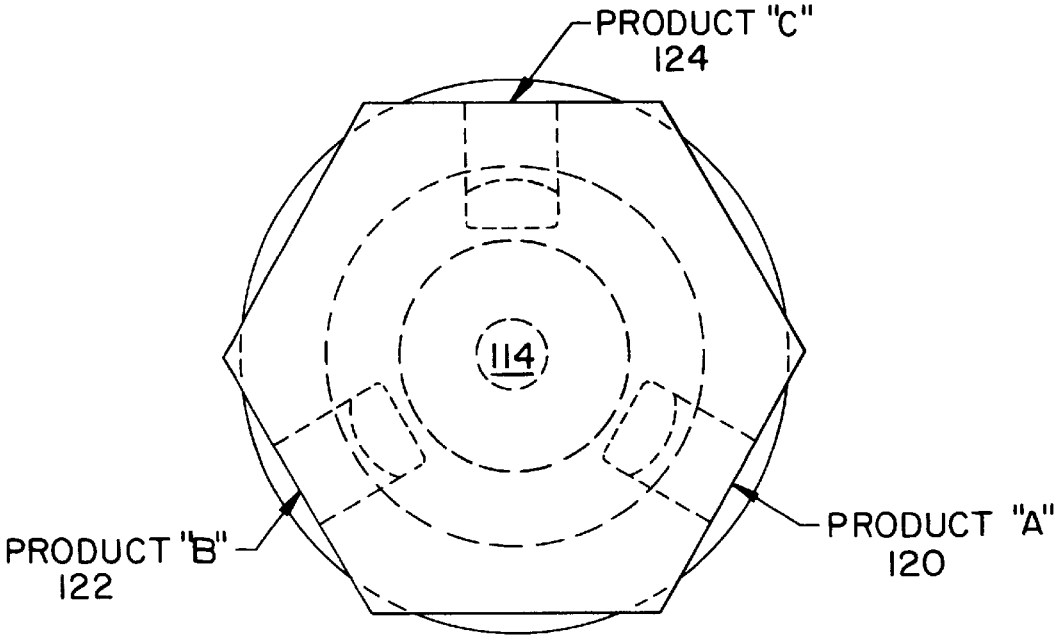
FIG. 9 is a top elevational view of a selector valve used in accordance with one embodiment of the current invention.

Single inlet multi-directional selector valve 64 can take different forms. FIGS. 9 and 10 illustrate one embodiment of the single inlet multi-directional selector valve. Fluid sources 10, 12 and 14 supply fluid through connection lines 16, 18 and 20 to pumps 22, 24 and 26. Fluid from these sources is then communicated to single inlet multi-directional selector valve 64. In the embodiment illustrated in FIGS. 9 and 10, single inlet multi-directional selector valve 64 comprises a selector valve which will be utilized to produce the desired blending of fluids from fluid sources 10, 12 and 14, for example. Connection lines 16, 18 and 20 provide a fluid flow from fluid sources 10, 12 and 14, respectively. This fluid flow enters single inlet multi-directional selector valve 64 via fluid entry ports 120, 122, and 124. After receiving the desired product, fluid exits single inlet multi-directional selector valve 64 at outlet port 114. This fluid is then communicated along meter inlet line 70 to meter 40.

Figure 11:
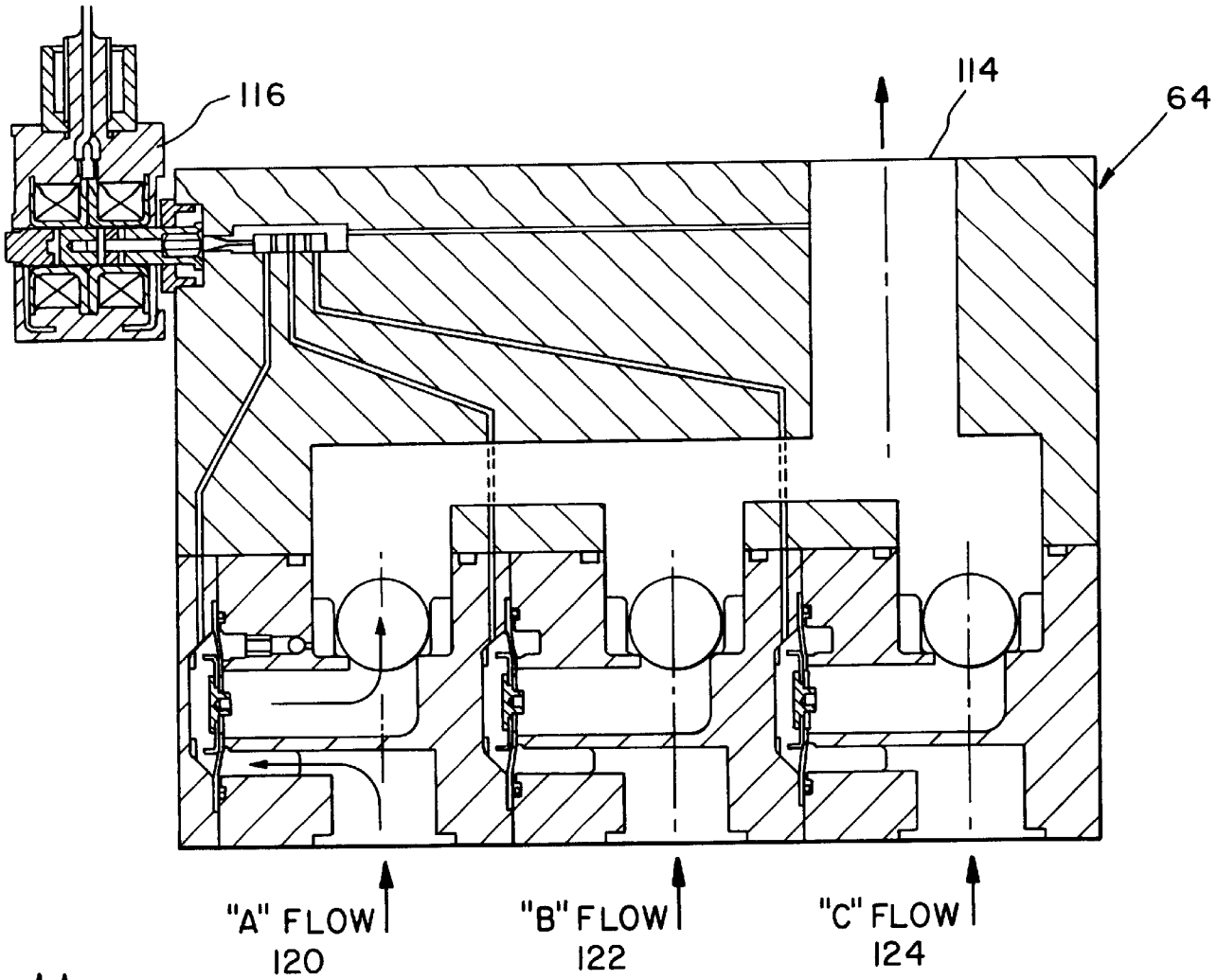
FIG. 11 is a cross sectional view of the single outlet multi-directional selector valve used in accordance with one embodiment of the current invention.

FIG. 11 illustrates an additional embodiment of single inlet multi-directional selector valve 64. Solenoid 116 controls the product selector valve illustrated in FIG. 11 and produces an accurately blended or non-blended fluid to be output at outlet port 114. Connection lines 16, 18 and 20 provide a fluid flow from fluid sources 10, 12 and 14, respectively. This fluid flow enters single inlet multi-directional selector valve 64 via fluid entry ports 120, 122, and 124. After receiving the desired product, fluid exits single inlet multi-directional selector valve 64 at outlet port 114. This fluid is then communicated along meter inlet line 70 to meter 40.

Figure 12:
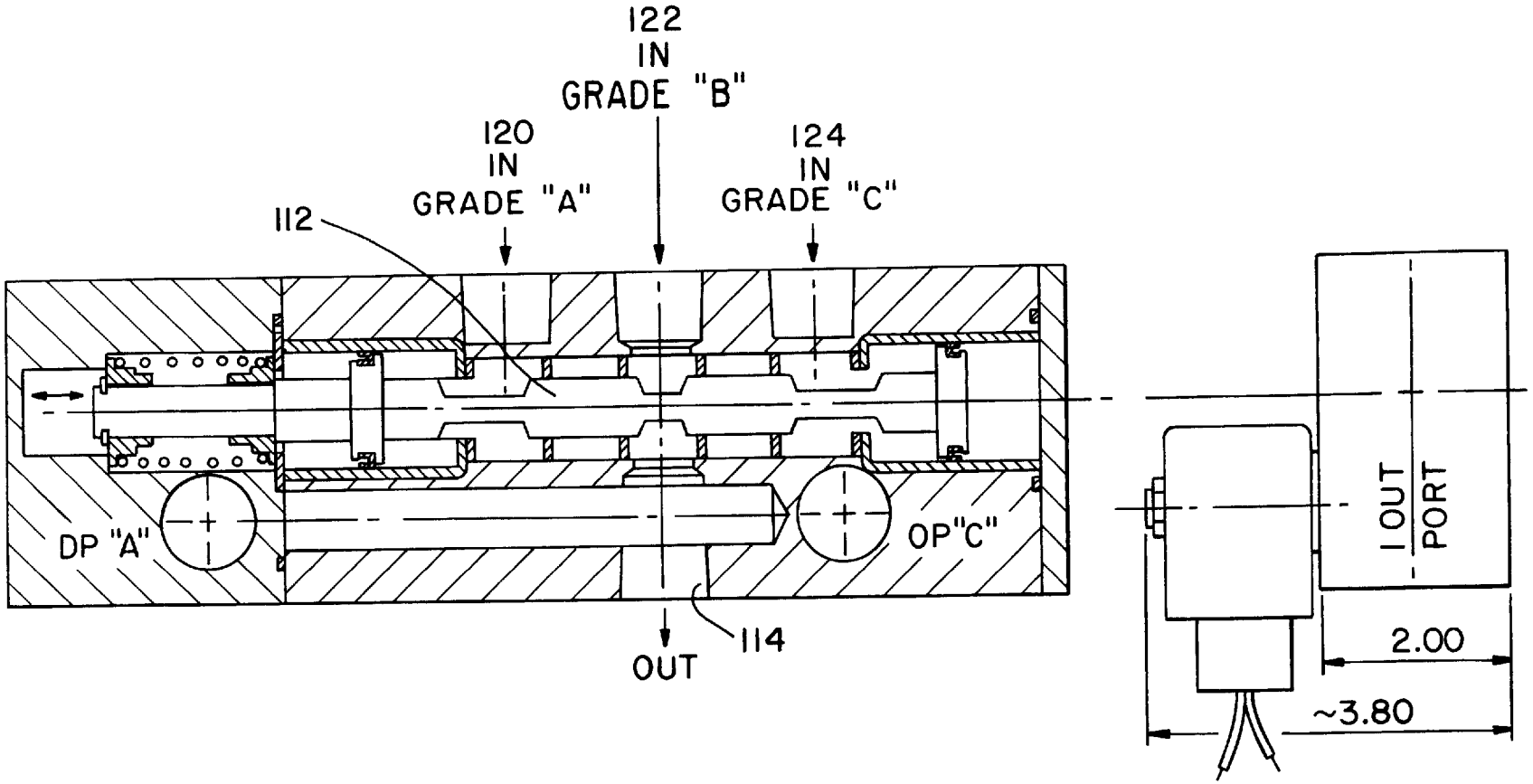
FIG. 12 is a cross sectional view of the single outlet multi-directional selector valve of one embodiment of the current invention.

FIG. 12 illustrates yet another embodiment of single inlet multi-directional selector valve 64. In this configuration, fluid supplied by fluid sources 10, 12 and 14 enters single inlet multi-directional selector valve 64 via entry ports 120, 122 and 124. In this embodiment, mixing control 112 may be linearly actuated to effect the desired fluid composition which then exits single inlet multi-directional selector valve 64 via outlet port 114.

In other embodiments of the present invention (not illustrated) it is possible to include the single inlet multi-directional selector valve of FIG. 5 with the outlet control valves of FIG. 1. In another embodiment of the present invention it is possible to include the inlet selector valves of FIG. 1 with the single outlet multi-directional selector valve of FIG. 5. It is also possible for other embodiments of the present invention to include multiple dispensers in accordance with FIGS. 1–7 where the same liquid sources are used. Although FIGS. 1–7 display three fluid sources and one or three fluid discharge outlets/nozzles, the present invention is not limited to the displayed number of fluid sources and fluid discharge outlets/nozzles.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for blending and dispensing fluid, comprising:

at least two fluid sources;

a fluid discharge outlet;

an inlet selector valve for each of said fluid sources, each of said inlet selector valves in fluid communication with and controlling the flow of fluid from each of said fluid sources;

a single meter, each of said inlet selector valves being in fluid communication with said meter, said meter in fluid communication with said fluid discharge outlet, said meter measuring the amount of fluid discharged through said fluid discharge outlet;

a means to purge said flow of fluid, said means in fluid communication with said flow of fluid for purging said flow of fluid from each of said inlet selector valves to said fluid discharge outlet; and a controlling device, said controlling device controlling each of said inlet selector valves whereby obtaining said flow of fluid from at least one of said fluid sources to obtain the desired fluid ratio for said fluid discharge outlet, said controlling device also controlling said means to purge said flow of fluid to a source.

2. The apparatus of claim 1, wherein said means to purge utilizes a multi-directional bypass control valve.

3. The apparatus of claim 1, wherein said flow of fluid is purged to one of said fluid sources.

4. The apparatus of claim 1, wherein said flow of fluid is purged to a conforming fluid source.

5. The apparatus of claim 1, wherein the fluid communication for each of said inlet selector valves to said meter combines into a single passageway in fluid communication with said meter.

6. The apparatus of claim 1, further comprising:

a pump for each of said fluid sources, said pump responsive to said controlling device for producing the desired fluid ratio.

7. The apparatus of claim 1, wherein said fluid discharge outlet is a fluid discharge nozzle.

8. An apparatus for blending and dispensing fluid, comprising:

at least two fluid sources;

a fluid discharge outlet;

a single inlet multi-directional selector valve, each of said fluid sources being in fluid communications with said inlet multi-directional selector valve, said inlet multi-directional selector valve controlling the flow of fluid from each of said fluid sources;

a single meter, said inlet multi-directional selector valve being in fluid communication with said meter, said meter in fluid communication with said fluid discharge outlet, said meter measuring the amount of fluid discharged through said fluid discharge outlet;

a means to purge said flow of fluid, said means in fluid communication with said flow of fluid for purging said flow of fluid from said inlet multi-directional selector valve to said fluid discharge outlet; and a controlling device, said controlling device controlling said inlet multi-directional selector valve whereby obtaining said flow of fluid from at least one of said fluid sources to obtain the desired fluid ratio for said fluid discharge outlet, said controlling device also controlling said means to purge said flow of fluid to a source.

9. The apparatus of claim 8, wherein said means to purge is a multi-directional bypass control valve.

10. The apparatus of claim 8, wherein said means to purge is in fluid communication with said inlet multi-directional selector valve.

11. The apparatus of claim 8, wherein said flow of fluid is purged to one of said fluid sources.

12. The apparatus of claim 8, wherein said flow of fluid is purged to the corresponding fluid source.

13. The apparatus of claim 8, further comprising:

a pump for each of said fluid sources, said pump responsive to said controlling device for producing the desired fluid ratio.

14. The apparatus of claim 8, wherein said fluid discharge outlet is a fluid discharge nozzle.

15. An apparatus for blending and dispensing fluid, comprising:

at least two fluid sources;

at least two fluid discharge outlets;

an inlet selector valve for each of said fluid sources, each of said inlet selector valves in fluid communication with and controlling the flow of fluid from each of said fluid sources;

a single meter, each of said inlet selector valves being in fluid communication with said meter, said meter measuring the amount of fluid discharged through said fluid discharge outlets;

an outlet control valve for each of said fluid discharge outlets, each of said outlet control valves in fluid communication with said meter and controlling the flow of fluid to each of said fluid discharge outlets;

a means to purge said flow of fluid, said means in fluid communication with said flow of fluid for purging said flow of fluid from each of said inlet selector valves to each of said fluid discharge outlets; and a controlling device, said controlling device controlling each of said inlet selector valves whereby obtaining said flow of fluid from at least one of said fluid sources to obtain the desired fluid ratio, said controlling device also controlling each of said outlet control valves whereby directing said flow of fluid to one fluid discharge outlet, said controlling device further controlling said means to purge said flow of fluid to a source.

16. The apparatus of claim 15, wherein said means to purge is a multi-directional bypass control valve.

17. The apparatus of claim 15, wherein said flow of fluid is purged to one of said fluid sources.

18. The apparatus of claim 15, wherein said flow of fluid is purged to the corresponding fluid source.

19. The apparatus of claim 15, wherein the fluid communication for each inlet selector valve to said meter combines into a single passageway in fluid communication with said meter.

20. The apparatus of claim 15, wherein a single passageway is in fluid communication with said meter before splitting into fluid communication with each of said fluid discharge outlets.

21. The apparatus of claim 15, further comprising:

a pump for each of said fluid sources, said pump responsive to said controlling device for producing the desired fluid ratio.

22. The apparatus of claim 15, wherein said fluid discharge outlet is a fluid discharge nozzle.

23. An apparatus for blending and dispensing fluid, comprising:

at least two fluid sources;

at least two fluid discharge outlets;

a single inlet multi-directional selector valve, each of said fluid sources being in fluid communication with said inlet multi-directional selector valve, said inlet multi-directional selector valve controlling the flow of fluid from each of said fluid sources;

a single meter, said inlet multi-directional selector valve being in fluid communication with said meter, said meter measuring the amount of fluid discharged through said fluid discharge outlets;

a single outlet multi-directional selector valve, said meter being in fluid communication with said outlet multi-directional selector valve, said outlet multi-directional selector valve controlling said flow of fluid to said fluid discharge outlets;

a means to purge said flow of fluid, said means in fluid communication with said flow of fluid for purging said flow of fluid from said inlet multi-directional selector valve to said fluid discharge outlets; and, a controlling device, said controlling device controlling said inlet multi-directional selector valve whereby obtaining said flow of fluid from at least one of said fluid sources to obtain the desired fluid ratio, said controlling device also controlling said outlet multi-directional selector valve whereby directing said flow of fluid to one fluid discharge outlet, said controlling device further controlling said means to purge said flow of fluid to a source.

24. The apparatus of claim 23, wherein said means to purge is a multi-directional bypass control valve.

25. The apparatus of claim 23, wherein said means to purge is in fluid communication with said inlet multi-directional selector valve.

26. The apparatus of claim 23, wherein said flow of fluid is purged to one of said fluid sources.

27. The apparatus of claim 23, wherein said flow of fluid is purged to the corresponding fluid source.

28. The apparatus of claim 23, further comprising:

a pump for each of said fluid sources, said pump responsive to said controlling device for producing the desired fluid ratio.

29. The apparatus of claim 23, wherein said fluid discharge outlet is a fluid discharge nozzle.

30. A method for dispensing fluid comprising the steps of:

providing at least two fluid sources;

providing a fluid discharge outlet;

extracting fluid from said fluid sources to achieve a desired fluid ratio;

passing fluid extracted from each of said fluid sources through a single meter;

dispensing fluid passed through said meter to said fluid discharge outlet; and purging said fluid after dispensing from said single meter and discharge outlet.

31. The method of claim 30, wherein:

providing a single multi-directional selector valve between said fluid sources and said meter;

controlling said multi-directional selector valve whereby fluid flows from said fluid sources to obtain the desired fluid ratio.

32. The method of claim 30, wherein:

providing a multi-directional bypass control valve for purging said fluid.

33. The method of claim 30, wherein:

said step of extracting fluid from said minimum of one fluid source comprises pumping fluid for each of said minimum of one fluid source.

34. A method for dispensing fluid comprising the steps of:

providing at least two fluid sources;

providing at least two fluid discharge outlets;

extracting fluid from said fluid sources to achieve a desired fluid ratio;

passing fluid extracted from each of said fluid sources through a single meter;

dispensing fluid passed through said meter to said fluid discharge outlets; and purging said fluid after said dispensing of said fluid from said fluid discharge outlets and said meter.

35. The method of claim 34, wherein:

providing a single multi-directional selector valve between said fluid sources and said meter; and controlling said multi-directional selector valve whereby fluid flows from said fluid sources to obtain the desired fluid ratio.

36. The method of claim 34, wherein:

providing a single multi-directional selector valve between said meter and said fluid discharge outlets; and controlling said multi-directional selector valve whereby fluid flows from said meter to one fluid discharge outlet.

37. The method of claim 34, wherein:

providing a multi-directional bypass control valve for purging said remaining fluid.

38. The method of claim 34, wherein:

said step of extracting fluid from said minimum of one fluid source comprises pumping fluid for each of said minimum of one fluid source.

* * * * *